US012111053B2

(12) United States Patent
McDaniel

(10) Patent No.: US 12,111,053 B2
(45) Date of Patent: Oct. 8, 2024

(54) TABLE-TOP LIGHTERS

(71) Applicant: VPR Brands, LP, Ft Lauderdale, FL (US)

(72) Inventor: Kegan McDaniel, Milwaukee, WI (US)

(73) Assignee: VPR Brands, LP, Sunrise, FL (US)

( * ) Notice: Subject to any disclaimer, the term of this patent is extended or adjusted under 35 U.S.C. 154(b) by 347 days.

(21) Appl. No.: 17/494,595

(22) Filed: Oct. 5, 2021

(65) Prior Publication Data

US 2023/0106153 A1 Apr. 6, 2023

(51) Int. Cl.
*F23Q 2/16* (2006.01)
*A24F 13/22* (2006.01)
*F23Q 2/167* (2006.01)

(52) U.S. Cl.
CPC ..... *F23Q 2/167* (2013.01); *A24F 13/22* (2013.01); *F23Q 2/164* (2013.01)

(58) Field of Classification Search
CPC ..... F23Q 2/167; F23Q 2/164; A24F 13/22
USPC ..... 431/153
See application file for complete search history.

(56) References Cited

U.S. PATENT DOCUMENTS 1,687,362 A * 10/1928 Cole ..... A24F 19/0064 131/239
2,582,598 A * 1/1952 McGuire ..... F23Q 2/32 131/234
3,450,143 A * 6/1969 Tamarin ..... F23Q 2/00 431/88
3,486,075 A * 12/1969 Herrmann ..... F23Q 3/002 431/255
3,891,381 A 6/1975 Moriya
5,454,713 A * 10/1995 Lee ..... F23Q 2/164 431/153
5,605,226 A * 2/1997 Hernlein ..... A24F 15/18 206/86
6,099,300 A 8/2000 Rice
6,151,781 A * 11/2000 Dehler ..... A24F 13/26 30/113
2003/0022119 A1* 1/2003 Wong ..... F23Q 2/165 431/255
2004/0115579 A1* 6/2004 Lin ..... F23Q 2/164 431/153
2009/0068602 A1* 3/2009 Smith ..... F23Q 2/42 206/459.1
2009/0068604 A1* 3/2009 Smith ..... F23Q 2/42 431/153

OTHER PUBLICATIONS

European Patent Office, "Extended European Search Report", issued in connection with European patent No. 22199383.5, Feb. 7, 2023, 4 pages.
European Patent Office, "Communication pursuant to Article 94(3) EPC" in connection with European Patent Application No. 22199383, issued on Feb. 17, 2023, 4 pages.

* cited by examiner

*Primary Examiner* — Avinash A Savani
(74) *Attorney, Agent, or Firm* — Hanley, Flight & Zimmerman, LLC

(57) ABSTRACT

Lighters are disclosed herein. An example lighter includes a base and a flame ignition assembly at least partially disposed in the base. The flame ignition assembly includes a nozzle. The example lighter also includes a button having an opening. The nozzle is disposed in the opening of the button. The is button to, when depressed, cause the flame ignition assembly to produce a flame at the nozzle.

19 Claims, 8 Drawing Sheets

TABLE-TOP LIGHTERS

FIELD OF THE DISCLOSURE

This disclosure relates generally to lighters and, more particularly, to table-top lighters.

BACKGROUND

Lighters are available in many shapes, sizes, and styles. Most pocket lighters have an elongated body or housing containing lighter fluid and a button or trigger located at one end of the housing that is used to activate the lighter to produce a flame. To use the pocket lighter, the pocket lighter is typically grasped in the hand of a person and the person uses his/her thumb to press the button or trigger to produce the flame.

Figure 1:
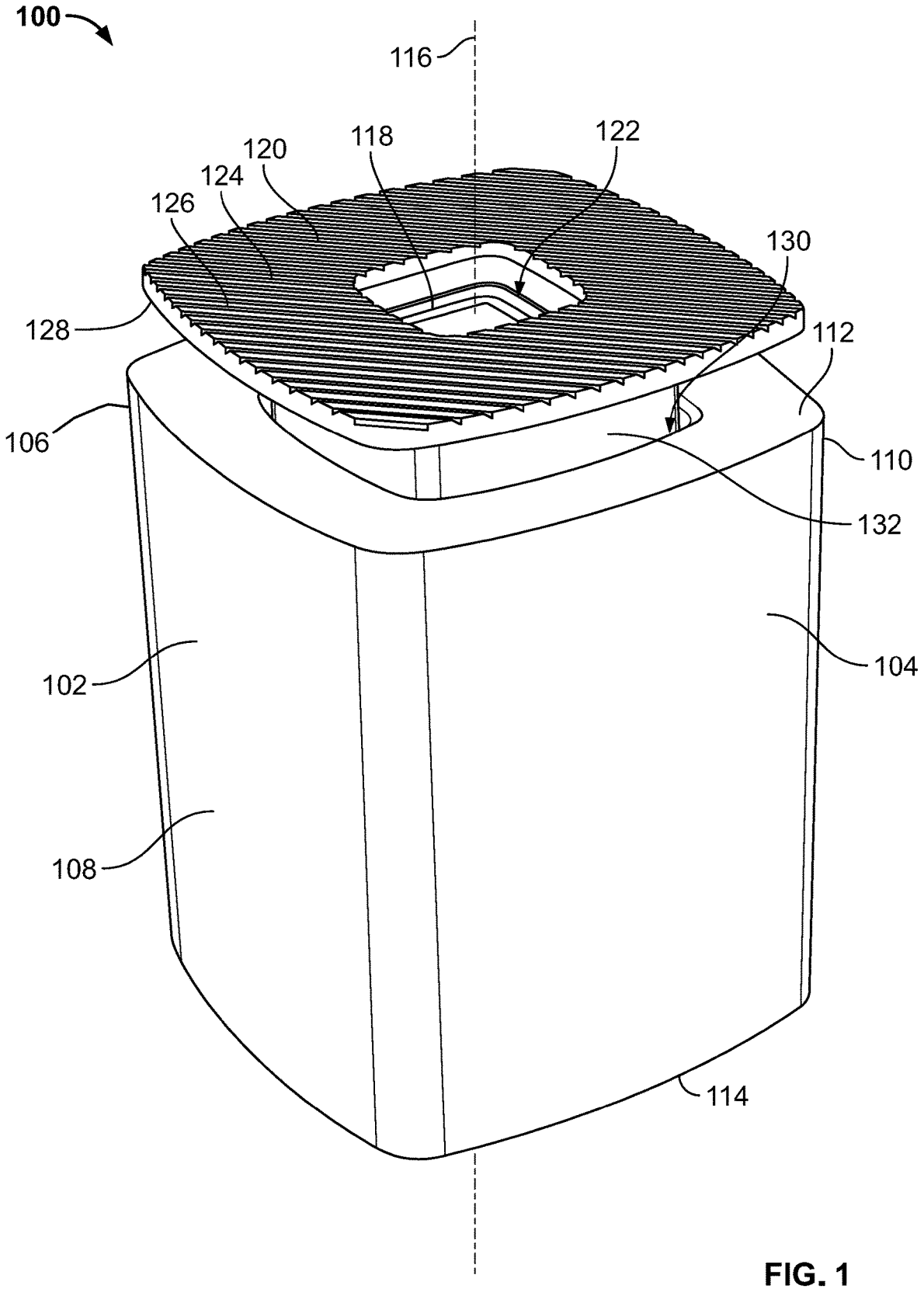
FIG. 1 is a perspective view of an example lighter constructed in accordance with the teachings of this disclosure.

The figures are not to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular. In general, the same reference numbers will be used throughout the drawing(s) and accompanying written description to refer to the same or like parts. As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another.

As used in this patent, stating that any part (e.g., a layer, film, area, region, or platform) is in any way on (e.g., positioned on, located on, disposed on, or formed on, etc.) another part, indicates that the referenced part is either in contact with the other part, or that the referenced part is above the other part with one or more intermediate part(s) located therebetween. As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name. As used herein, "approximately" and "about" refer to dimensions that may not be exact due to manufacturing tolerances and/or other real world imperfections.

DETAILED DESCRIPTION

Handheld lighters are used for a variety of purposes, such as lighting a cigarette, lighting a fire, starting a grill, lighting a candle, etc. Known handheld lighters are generally rectangular or cylindrically shaped and have a button, trigger, or lighting mechanism on one end. To light an object such as a cigarette, for example, the lighter can be held in a person's hand in a generally vertical or upright orientation. However, to activate the lighter, the lighter must be held in a specific orientation in the person's hand so that the user can press the trigger or button with his/her thumb. This often requires a person to adjust the position of the lighter in his/her hand after picking up the lighter. Also, some people may be uncomfortable with pressing the button or trigger with his/her thumb (e.g., due a medical condition).

Disclosed herein are example lighters, which may be referred to as table-top lighters, that can be ignited from various angles or orientations in a person's hand or while setting on a surface such as a table or counter. As such, a person holding and/or using the lighter does not have to readjust his/her hand. Further, if the lighter is set on a surface such as a table, one or more persons sitting around the lighter can activate the lighter from their various positions without having to re-orient the lighter.

An example lighter disclosed herein includes a base or housing have a top side. The lighter includes a flame ignition assembly at least partially disposed in the base. As used herein, a flame ignition assembly means the one or more components used to create or produce a flame, such as a spark wheel, a stone, a piezoelectric element, an adjusting wheel, a nozzle, a wick or tube, and/or a fuel container or reservoir with fuel. The example lighter includes a nozzle guide with one or more nozzles or jets that extend upward from a center of the top side of the base. The example lighter also includes a button (sometimes referred to as trigger) above the top side. The button is moveable up and down (i.e., via translational motion) relative to the base. The button has an opening extending through the button. The nozzle guide and the nozzle(s) is/are disposed in the opening. The button has a platform, and the opening extends through the platform. In some examples, the opening extends through a center of the platform. A person can press down on the platform to move the button downward toward the base, which exposes the nozzles(s), and which causes the flame ignition assembly to produce a flame at the nozzle(s). The flame is produced at or near (e.g., above) a center of the platform. As such, the platform substantially surrounds the nozzle guide and nozzle(s). Therefore, the platform can be contacted and pressed down by one or more persons at any orientation (e.g., 360°) around the lighter. For example, a person can hold the base in his/her hand and press down on the platform with his/her thumb (or another finger) at any orientation in the person's hand. Further, the lighter can be set on a surface, such as a table or counter, and people positioned around the table can press down on the platform from their position to ignite the lighter. The platform can be pressed downward with any finger of the person. As such, person's do not need to use his/her thumb to light the lighter as typical with known lighters.

FIG. 1 is a perspective view of an example lighter 100 constructed in accordance with the teachings of this disclosure. The lighter 100 can be used to produce a flame, which can be used for lighting any object, such as a candle, a cigarette, a cigar, a firework, etc. The example lighter 100 may be considered a table-top lighter because the lighter 100 can be set on a table or other surface and activated. However, in some examples, the lighter 100 also may be relatively small and portable and, thus, may also be referred to as a pocket lighter or a handheld lighter.

In the illustrated example, the lighter 100 includes a base 102. The base 102 may also be referred to as a body or housing. The base 102 can be held in a hand of a person when lighting the lighter 100 and/or can be set on a surface (e.g., table, a counter, a desk, a bar top, etc.) when lighting the lighter 100. In this example, the base 102 is cuboid-shape. The base 102 has a first side 104, a second side 106 opposite the first side 104, a third side 108 between the first and second sides 104, 106, and a fourth side 110 between the first and second sides 104, 106 opposite the third side 108. The base 102 also has a top side 112 (between the sides 104, 106, 108, 110), and a bottom side 114 (between the sides 104, 106, 108, 110) opposite the top side 112. The base 102 can be set on a table or other surface with the bottom side 114 facing downward. In some examples, the base 102 is constructed of plastic and/or metal (e.g., aluminum). In other examples, the base 102 can be constructed of other materials. The base 102 has a central or longitudinal axis 116. The base 100 has a nozzle guide 118 extending upward from the top side 112. The lighter 100 includes a flame ignition assembly (shown in further detail herein) having one or more nozzles or jets in the nozzle guide 118. The nozzle(s) eject(s) fuel (e.g., Naphtha, butane, etc.) to produce a flame.

In the illustrated example, the lighter 100 includes a button 120 (which may also be referred to as a trigger). The button 120 is moveably coupled to the base 102. In particular, the button 120 is moveable relative to the base 102. When the button 120 is pressed (e.g., moved downward toward the base 102), the button 120 causes the flame ignition assembly to produce a flame at the nozzle(s). In the illustrated example, the button 120 has an opening 122 (e.g., a through-hole) extending through the button 120. The nozzle guide 118 extends into the opening 122 and, thus, the nozzle guide 118 and the nozzle(s) is/are disposed in the opening 122. When the button 120 is pressed, a flame is produced above the nozzle guide 118 and, thus, at or above the button 120.

In the illustrated example, the button 120 includes a platform 124, which may also be referred to as a plate. The platform 124 is positioned parallel to and spaced from the top side 112 of the base 102. The platform has a top side 126 and a bottom side 128 opposite the top side 126. A person can press the top side 126 of the platform 124 to move the button 120 downward and toward the base 102 to activate the lighter 100 to produce a flame. Therefore, in this example, the button 120 is moveable linearly along the axis 116. In the illustrated example, the top side 126 of the platform 124 is ribbed. In some examples, this enhances grip between the person's finger(s) and the button 120. In other examples, other textures and/or gripping features may be incorporated into the platform 124. In the illustrated example, the base 102 includes an opening 130 in the top side 112 of the base 102. The button 120 includes a guide 132 extending from the bottom side 128 of the platform 124 and into the opening 130 in the top side 112 of the base 102. The opening 122 in the button 120 extends through the platform 124 and the guide 132.

Figure 2A:
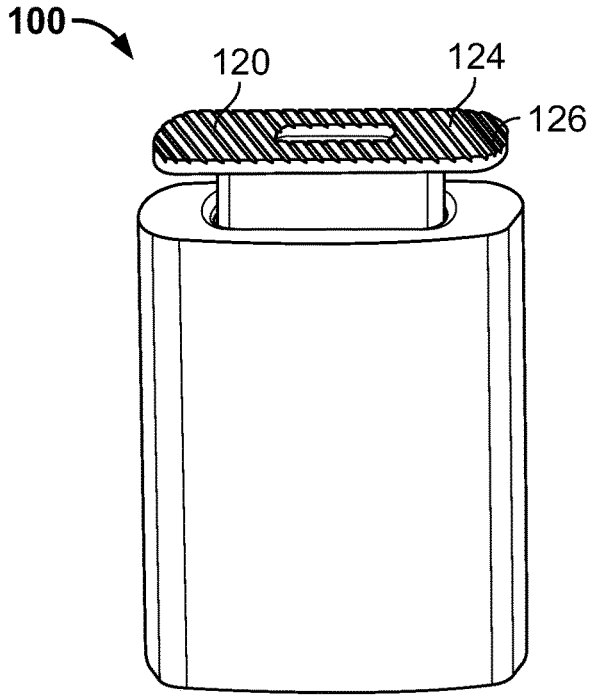
FIGS. 2A and 2B show an example button of the example lighter of FIG. 1 in a first (extended) position and a second (depressed) position, respectively.
Figure 2B:
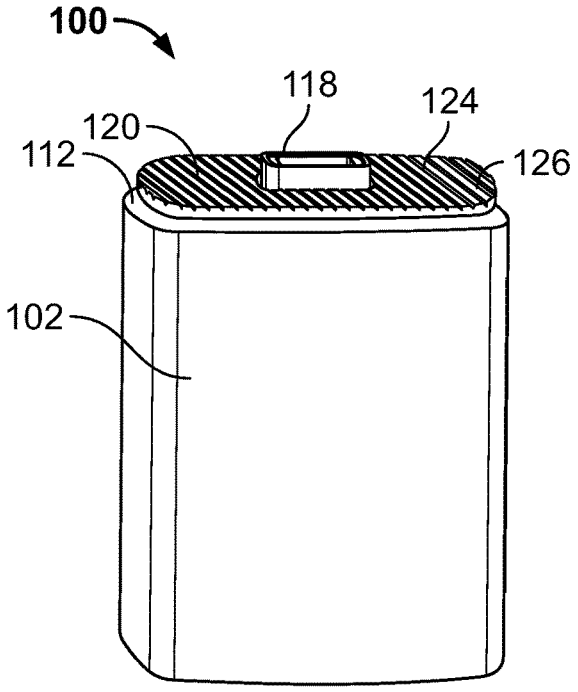

In this example, the lighter 100 is implemented as a click button lighter. When the button 120 is activated or triggered (e.g., pushed, depressed, etc.), a valve is opened that allows the fuel to flow from the nozzle(s), and a spark is created near the nozzles (e.g., via a piezoelectric element, via a spark wheel, etc.). The spark ignites the fuel, thereby creating a flame at the nozzle(s). In this example, the button 120 is depressed by moving the button 120 toward the top side 112 of the base 102. A person may touch the top side 126 of the platform 124 (e.g., with his/her finger) and press downward toward the base 102. The button 120 is moveable between a first (extended) position and a second (depressed) position. For example, FIG. 2A shows the lighter 100 with the button 120 in the first (extended) position, and FIG. 2B shows the button 120 after being depressed downward to the second (depressed) position. In this example, the nozzle guide 118 is disposed below the top side 126 of the platform 124 when the button 120 is in the first (extended) position shown FIG. 2A. However, the nozzle guide 118 extends from the top side 126 of the platform 124 when the button 120 is in the second (depressed) position shown in FIG. 2B. Therefore, the nozzle guide 118 and the nozzle(s) are exposed when the button 120 is depressed. In other examples, the nozzle guide 118 and/or the nozzle(s) may not extend beyond the top side 126 of the platform 124 when the button 120 is in the second (depressed) position.

Figure 3:
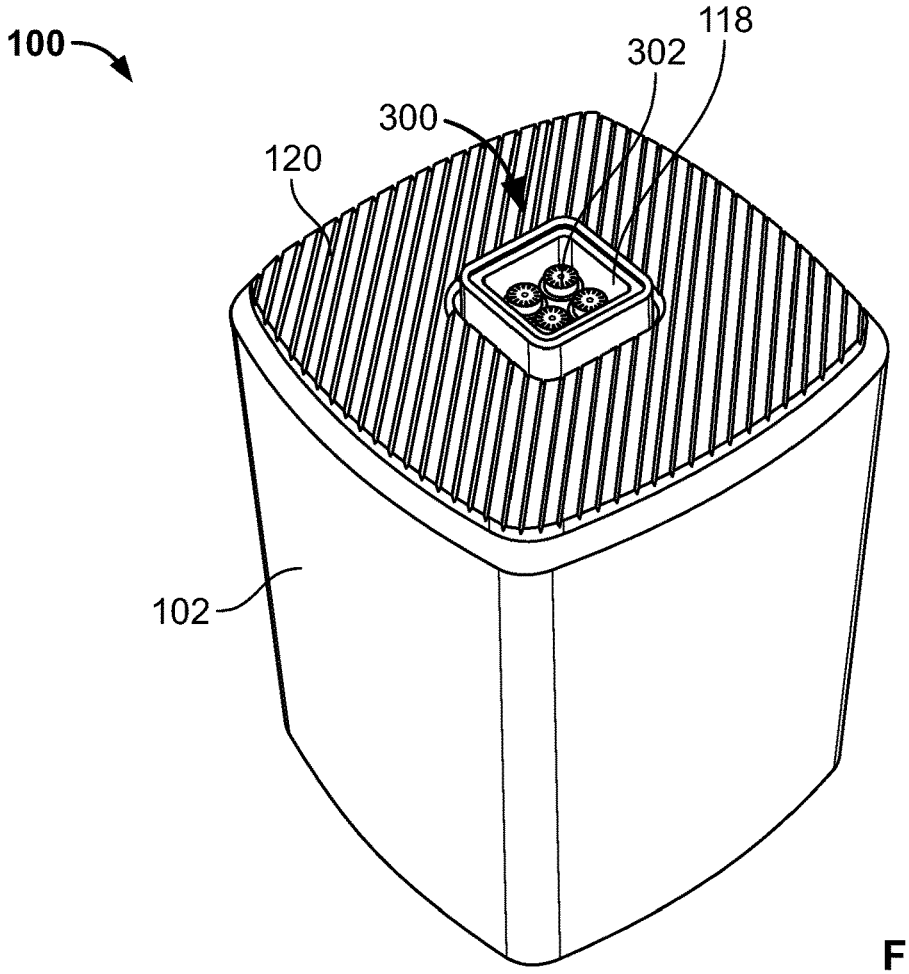
FIG. 3 is a top perspective view of the example lighter of FIG. 1 showing the example button in the second position.

FIG. 3 is perspective view of the example lighter 100 showing the button 120 in the second (depressed) position. The lighter 100 includes a flame ignition assembly 300 at least partially disposed in the base 102. As disclosed above, the flame ignition assembly 300 includes one or more nozzles (sometimes referred to as jets). In this example, the flame ignition assembly 300 includes four nozzles 302 (one of which is referenced in FIG. 3). The nozzles 302 are disposed in the nozzle guide 118. In this example, the nozzles 302 are arranged in a 2×2 configuration. In other examples, the flame ignition assembly 300 can include more or fewer nozzles and/or the nozzles can be arranged in other configurations. When the button 120 is moved to the second (depressed) position (FIG. 2B and FIG. 3), the button 120 causes the flame ignition assembly 300 to produce a flame at the nozzles 302. In some examples, the flame is maintained at the nozzle 302 as long as the button 120 is triggered (or until the fuel is consumed). In some examples, then the button 120 is released, the button 120 automatically returns to the first (extended) position in FIG. 2A. In some examples, the lighter 100 includes a spring or other biasing member that returns the button 120 to the first (extended) position when released.

In some examples, the flame ignition assembly 300 is a Naphtha-based assembly and includes Naphtha fluid disposed in the base 102. In other examples, the flame ignition assembly 300 may contain other types of fluid (e.g., butane). Further, while in the illustrated example the lighter 100 is implemented as a click button lighter, in other examples, the lighter 100 can be implemented as another type of lighter, such as an electric arc lighter, a lighter having a spark wheel, etc.

Referring back to FIG. 1, the button 120 is aligned above the base 102. A central or longitudinal axis of the button 120 is coaxial with the longitudinal axis 116 of the base. In the illustrated example, the opening 122 extends through a center of the button 120. Said another way, a central axis of the opening 122 is coaxial with the longitudinal axis 116 of the base 102. As such, the platform 124 substantially surrounds the opening 122 and the nozzle(s) 300. This enables a person to access and press the button 120 from any orientation (e.g., from 360° around the axis 116). For example, a person may hold the base 102 in his/her hand at any orientation and press the button 120 to activate the lighter 100. Therefore, unlike known lighters, the person does not need to hold the lighter 100 in a particular orientation in their hand to be able to press the button 120. Further, the lighter 100 can be set on a surface, such as a table, and one or more persons sitting or otherwise positioned around the lighter 100 can press the button 120 from their position without having to reorient the lighter 100.

Figure 4:
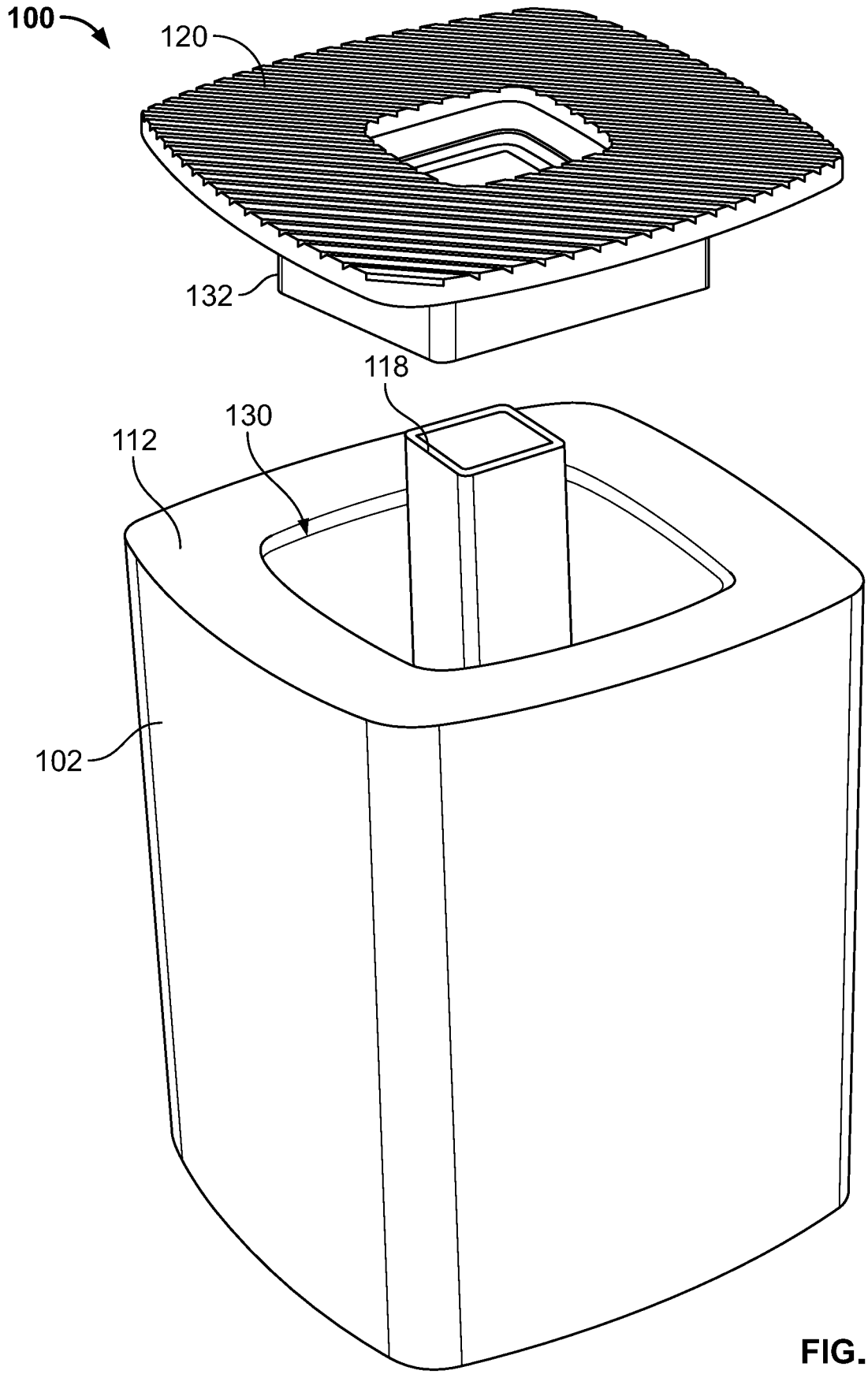
FIG. 4 is an exploded view of the example lighter of FIG. 1.

FIG. 4 is an exploded view of the example lighter 100 showing the button 120 above the base 102. As disclosed above, the base 102 has the nozzle guide 118 extending upward from the top side 112 of the base 102. When the lighter 100 is assembled, the nozzle guide 118 extends into the opening 122 in the button 120. When button 120 is moveable up and down relative to the nozzle guide 118. In some examples, the button 120 slides along an outer surface of the nozzle guide 118. Further, as disclosed above, the base 102 has the opening 130 in the top side 112. When the lighter 100 is assembled, the guide 132 of the button 120 extends into the opening 130. When the button 120 is depressed and released, the guide 132 moves up and down in the opening 130. In some examples, an outer surface of the guide 132 slides along an inner surface of the top side 112 forming the opening 130. In other examples the outer surface of the guide 132 may be spaced from the inner surface of the top side 112 forming the opening 130.

Figure 5:
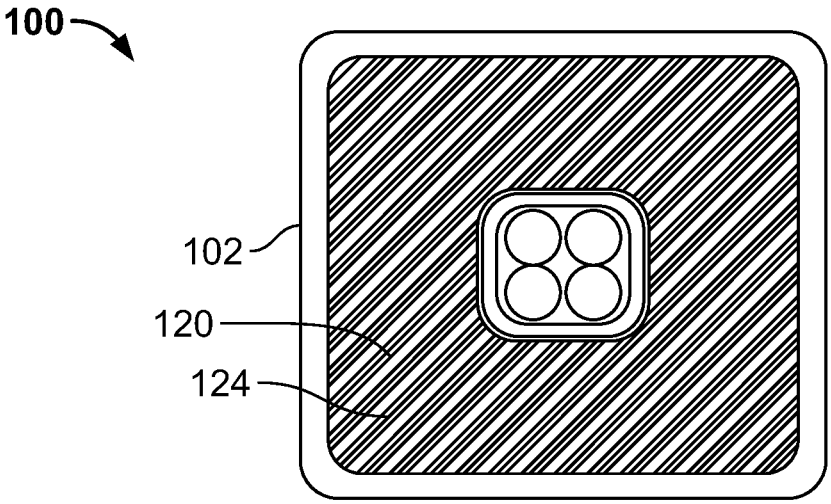
FIG. 5 is a top view of the example lighter of FIG. 1.

FIG. 5 is a top view of the lighter 100. As shown in FIG. 5, the platform 124 of the button 120 has a same cross-sectional shape as the base 102, which is a rounded square or rectilinear shape. In the illustrated example, the platform 124 has a smaller area (from the top view) than the base 102. In other examples, the platform 124 may have the same area or a larger area than the base 102. In other examples, the base 102 and/or the platform 124 of the button 120 can be shaped differently. For example, the base 102 may be a cylindrical shape, and the platform 124 may be a circular shape.

Figure 6:
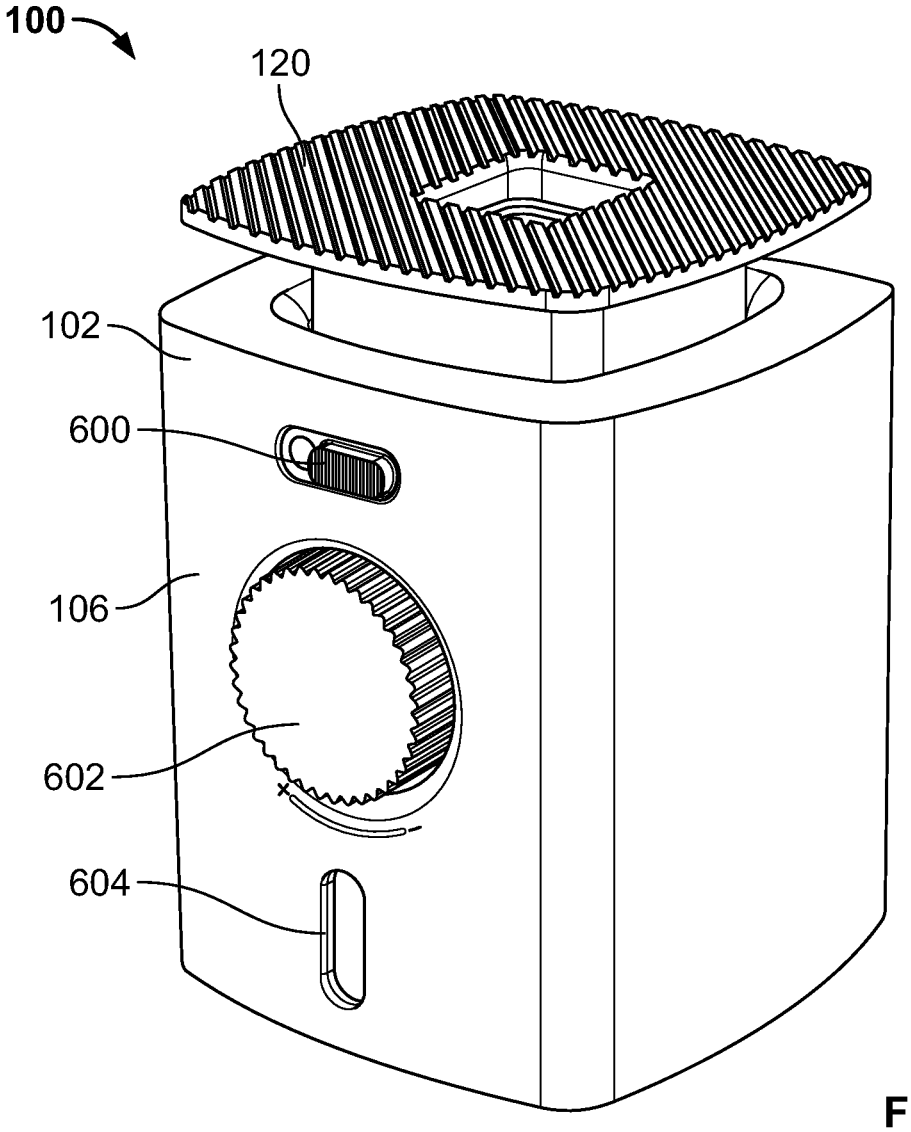
FIG. 6 is a perspective view of the example lighter of FIG. 1 showing multiple example features that can be included on a side of the example lighter.

FIG. 6 is a perspective view of the lighter 100 showing the second side 106. The lighter 100 can have one or more example features for controlling the lighter 100 and/or monitoring the status of the lighter 100. For example, the lighter 100 has an example safety lock 600 on the second side 106. The lock can be used to lock and prevent movement of the button 120 and, thus, prevent the lighter 100 from producing a flame. In this example, the lock 600 is a physical button or switch that can be moved (e.g., slid) between an unlocked position and a locked position. When the lock 600 is in the unlocked position, the button 120 can be depressed for normal operation. When the lock 600 is in the locked position, the button 120 is locked or otherwise prevented from moving downward.

In the illustrated example, the lighter 100 has an example flame adjustment dial 602 on the second side 106. The flame adjustment dial 602 can be rotated (e.g., clockwise or counter-clockwise) to increase or decrease the size of the flame. For example, the flame adjustment dial 602 can increase or decrease fuel flow through the nozzle(s) 300 (FIG. 3) to change a size of the flame. In other examples, the flame adjustment feature may be an adjustable toggle or other type of switch mechanism.

In the illustrated example, the lighter 100 has an example fuel level window 604 on the second side 106 to indicate a level of fuel in the lighter 100. The fuel level window 604 enables a person to view the level of fuel through the second side 106. In some examples, the fuel level window 604 is constructed of transparent plastic and/or glass. While in this example the lock 600, the flame adjustment dial 602, and the fuel level window 604 are on the second side 106 of the base 102, in other examples, one or more of the features can be on other sides of the base 102. Also, in other examples the lighter 100 can include fewer of these features, and/or the lighter 100 can include other features.

Figure 7:
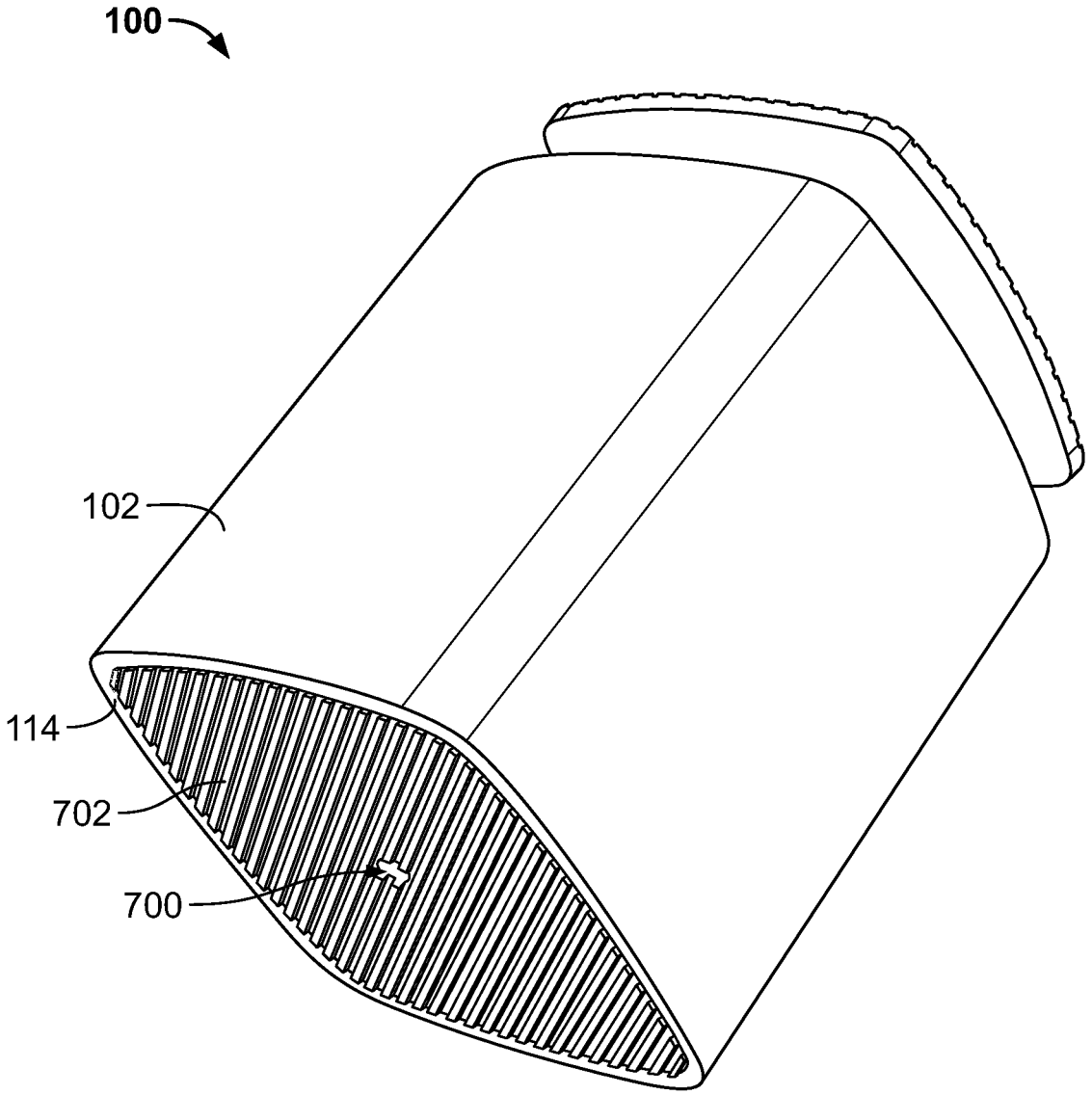
FIG. 7 is a bottom perspective view of the example lighter of FIG. 1.

FIG. 7 is a perspective view of the lighter 100 showing the bottom side 114 of the base 102. In some examples, the bottom side 114 of the base 102 has an example refill port 700. A user can insert a nozzle into the refill port 700 to refill a fuel container in the base 102 with fuel. In some examples, the lighter 100 has a grip pad 702 on the bottom side 114. The grip pad 702 enhances grip on a supporting surface (e.g., a table) to help reduce or prevent sliding. In some examples, the grip pad 702 is constructed of rubber. In other examples, the grip pad 702 can be constructed of other materials. In the illustrated example, the grip pad 702 is ribbed. In other examples, other textures and/or gripping features may be incorporated into the bottom side 114. In some examples, a portion of the bottom side 114 is removeable to enable access to the internal compartment of the base 102. In such examples, the grip pad 702 can be used to cover the fasteners such as rivets, screws, etc. on the bottom side 114 to enhance the aesthetic appearance of the lighter 100.

Figure 8A:
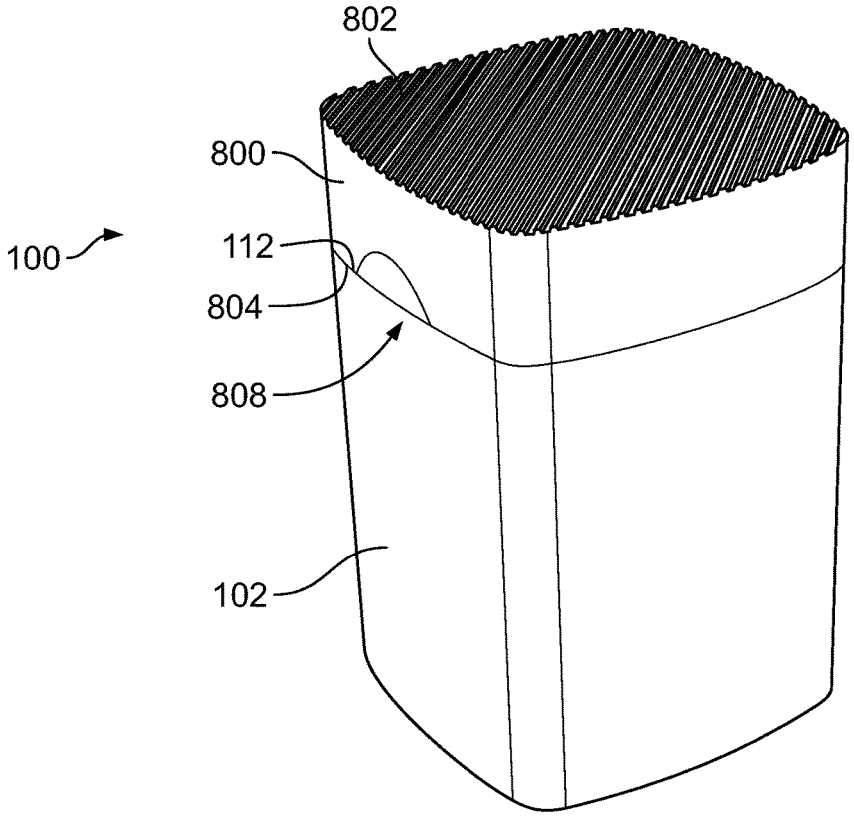
FIGS. 8A and 8B show the example lighter of FIG. 1 with an example lid that can be used as an ashtray.

In some examples, the lighter 100 may include a cover or lid that can be used as an ash tray. For example, FIG. 8A shows the example lighter 100 and an example lid 800 on the example lighter 100. The lid is removably positionable on the base 102 over the button 120, as shown in FIG. 8A. Thus, the button 120 cannot be depressed with the lid 800 is on the base 102. The lid 800 is removable from the base 102. In some examples, the lid 800 is removably couplable to the base 102 (e.g., via friction fit, via magnets, etc.). In the illustrated example, the lid 800 has a same cross-sectional shape as the base 102. As such, the outer surfaces of the lid 800 and the base 102 form a substantially continuous surface. In the illustrated example, the lid 800 has a top side 802 and a bottom side 804 opposite the top side 802. The bottom side 804 is engaged with the top side 112 of the base 102. In some examples, the top side 802 of the lid 800 is ribbed, which enhances grip when the lid 800 is set up-side-down on a surface (e.g., a table). In other examples, other textures and/or gripping features may be incorporated into the lid 800.

Figure 8B:
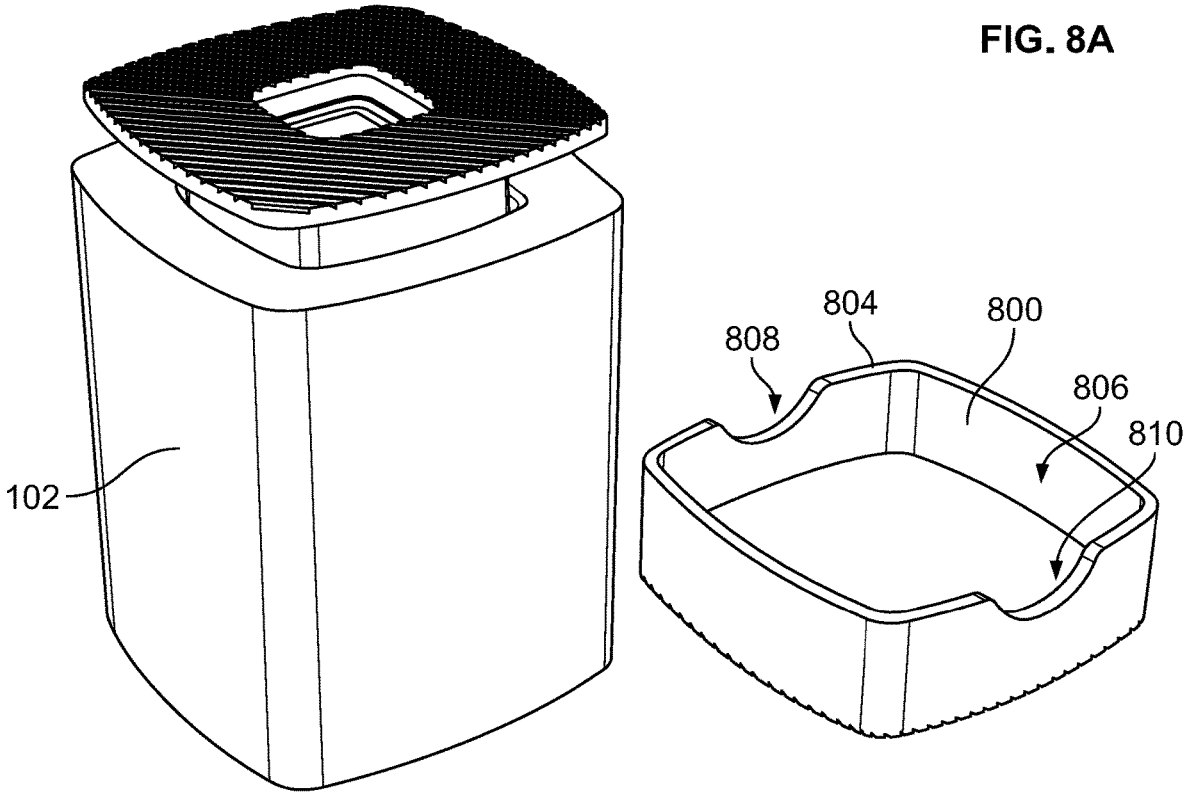

In some examples, the lid 800 can be used as an ashtray or receptacle for storage. For example, FIG. 8B shows the lid 800 as removed from the base 102 and set up-side-down. The lid 800 has a recess or cavity 806 extending into the bottom side 804, such that a wall is formed around the cavity 806. The cavity 806 can be used to collect ash from a cigarette, for example. The lid 800 can be turned over to empty the ash after use. As such, the lid 800 can serve as an ashtray when the lid 800 is detached from the base 102. In some examples, the lid 800 has one or more notches extending into the bottom side 804 (e.g., extending into the wall). For example, as shown in FIG. 8B, the lid 800 includes a first notch 808 and a second notch 810. In other examples, the lid 800 can include more or fewer notches. The notches 808, 810 can be used to support a cigarette or other smokeable product while lit to keep the lit end from laying on the lid 800 or other supporting surface. Further, as shown in FIG. 8A, the notches 808, 810 (only the notch 808 is shown FIG. 8A) can be used as finger holes when grabbing and removing the lid 800 from the base 102.

Figure 9A:
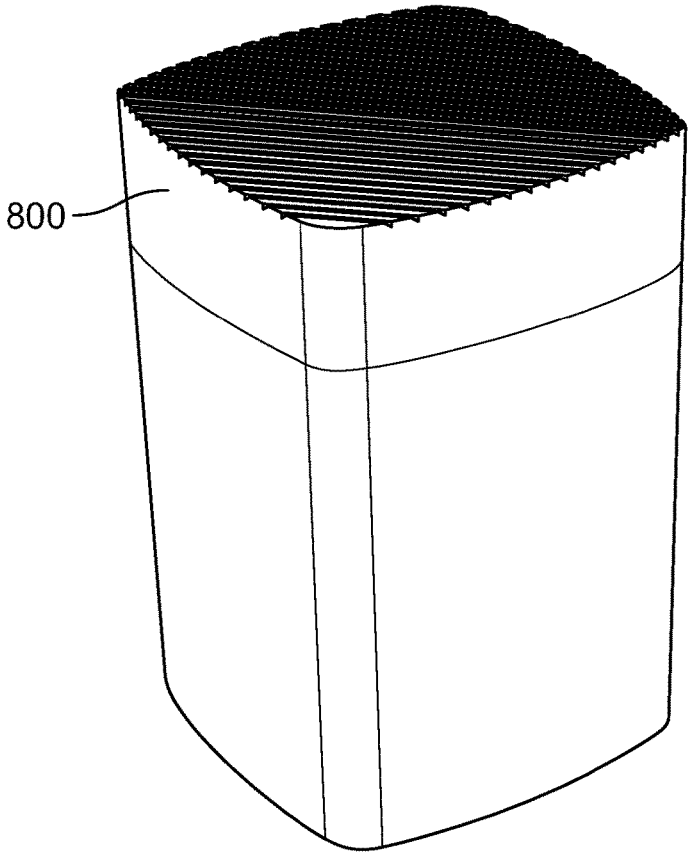
FIGS. 9A and 9B show the example lighter of FIG. 1 with alternative example lid that can be used as an ashtray.
Figure 9B:
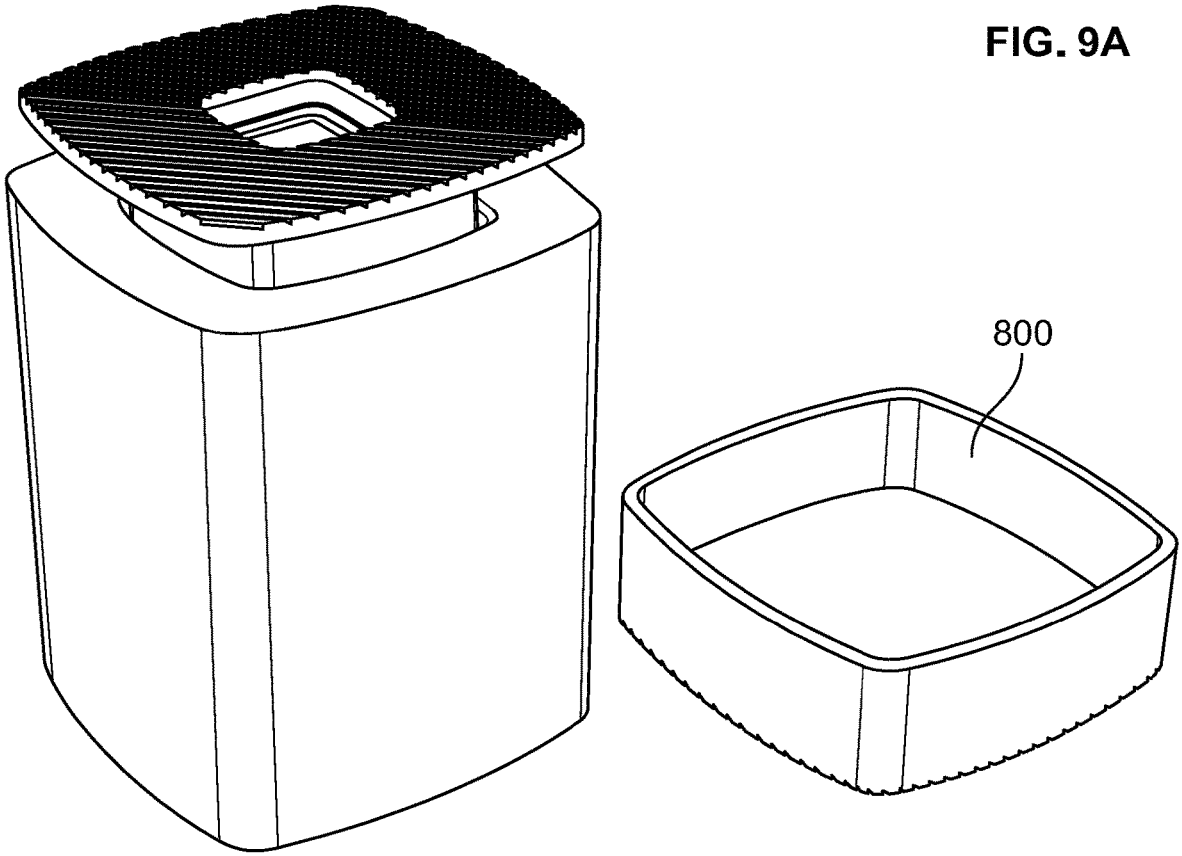

In other examples, the lid 800 may not have notches. For example, FIGS. 9A and 9B show an example in which the lid 800 does not have notches.

Figure 10:
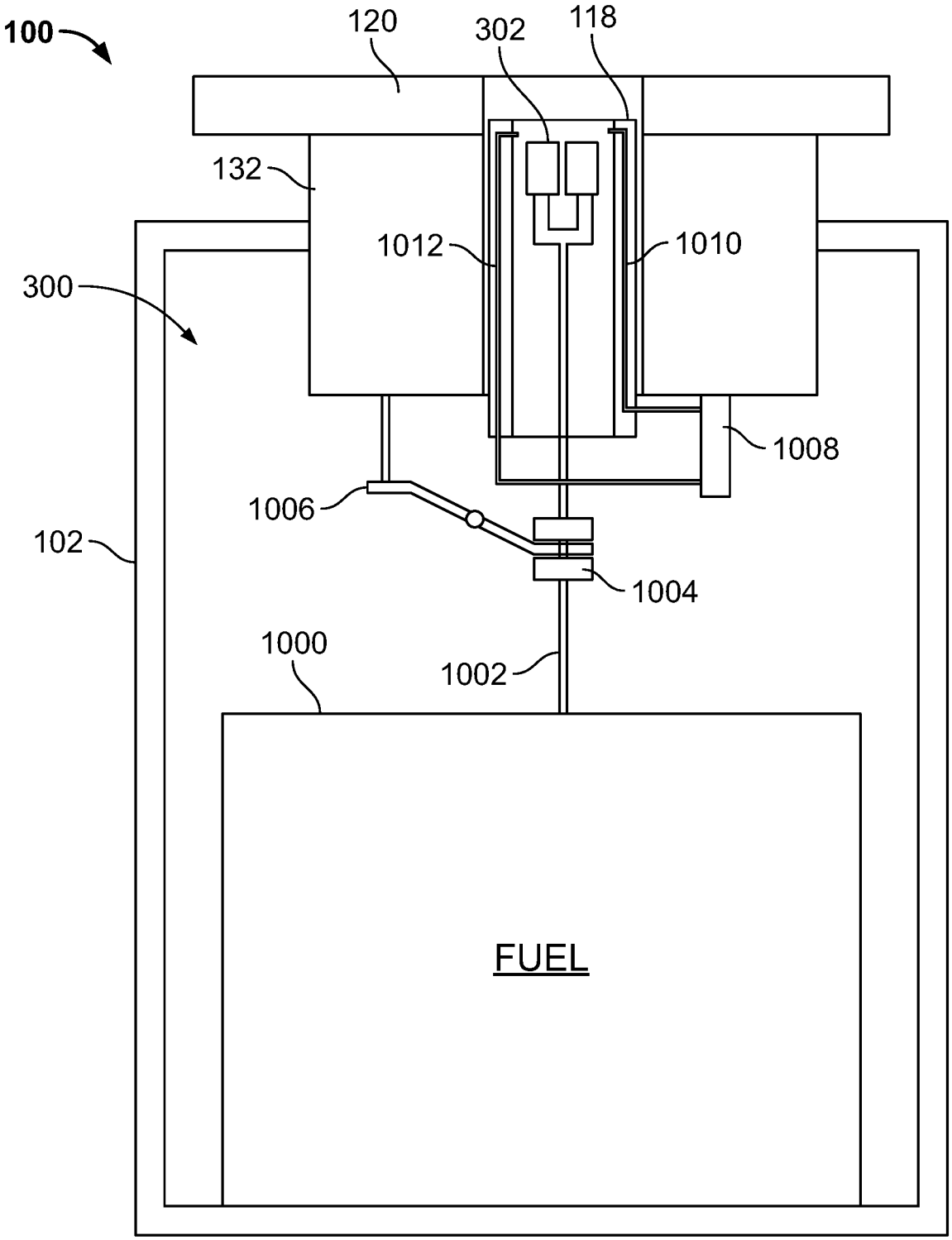
FIG. 10 is a schematic of an example flame ignition assembly of the example lighter of FIG. 1.

FIG. 10 is a schematic of the flame ignition assembly 300 of the lighter 100. As disclosed above, the flame ignition assembly 300 can be at least partially disposed in the base 102. In the illustrated example, the flame ignition assembly 300 includes an example fuel reservoir or container 1000 in the base 102. The fuel container 1000 can contain any type of lighter fluid, such as Naphtha or butane. The flame ignition assembly 300 includes an example fluid line or tube from the fuel container 1000 to the nozzles 302. In other examples, separate fluid lines or tubes can be coupled to respective ones of the nozzles 302. The flame ignition assembly 300 includes an example valve 1004 coupled to the fluid line 1002. The flame ignition assembly 300 includes an example lever 1006. When the button 120 is pressed downward, the guide 132 of the button 120 rotates the lever 1006, which opens the valve 1004 to enable the fuel to flow to the nozzles 302. In other examples, the valve 1004 can be controlled by other mechanical configurations.

In the illustrated example, the flame ignition assembly 300 includes an example piezoelectric element 1008 and example wires 1010, 1012 extending from the piezoelectric element 1008 to the opening of the nozzle guide 118. When the button 120 is pressed downward, the guide 132 engages and compresses the piezoelectric element 1008, which creates a spark between the two wires 1010, 1012 above the nozzles 302. When the button 120 is pressed downward, the fuel is ejected from the nozzles 302 and ignited by the spark. Therefore, a flame is produced above the nozzles 302 and above the button 120.

While in this example the flame ignition assembly 300 is a piezoelectric assembly, in other examples, the flame ignition assembly 300 can be implemented by another type of assembly, such as an electric arc assembly, an assembly having a spark wheel, etc.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

Examples and example combinations disclosed herein include the following:

Example 1 is a lighter comprising a base, a flame ignition assembly at least partially disposed in the base, the flame ignition assembly including a nozzle, and a button having an opening. The nozzle is disposed in the opening of the button. The button is to, when depressed, cause the flame ignition assembly to produce a flame at the nozzle.

Example 2 includes the lighter of Example 1, wherein the opening extends through a center of the button.

Example 3 includes the lighter of Examples 1 or 2, wherein a central axis of the opening is coaxial with a longitudinal axis of the base.

Example 4 includes the lighter of any of Examples 1-3, wherein the button includes a platform positioned parallel to and spaced from the base. The platform is to be pressed by a person to move the button toward the base.

Example 5 includes the lighter of Example 4, wherein the base includes a nozzle guide extending from the base. The nozzle guide is disposed in the opening of the button. The nozzle is disposed in the nozzle guide.

Example 6 includes the lighter of Example 5, wherein the button has an extended position and a depressed position. The nozzle guide is disposed below a top side of the platform when the button is in the extended position. The nozzle guide extends from the top side of the platform when the button is in the depressed position.

Example 7 includes the lighter of Examples 5 or 6, wherein the flame ignition assembly includes four nozzles arranged in a 2×2 configuration.

Example 8 includes the lighter of any of Examples 4-7, wherein the platform has a same cross-sectional shape as the base.

Example 9 includes the lighter of any of Examples 4-8, wherein the base has an opening in a top side of the base, and wherein the button has a guide extending from a bottom side of the platform and into the opening in the top side of the base.

Example 10 includes the lighter of any of Examples 4-9, wherein a top side of the platform is ribbed.

Example 11 includes the lighter of any of Examples 1-10, further including lid removably positionable on the base over the button. The lid has a cavity formed in a bottom side of the lid such that the lid can serve as an ashtray when the lid is detached from the base.

Example 12 includes the lighter of Example 11, wherein the bottom side of the lid has a notch to support a smokeable product.

Example 13 includes the lighter of any of Examples 1-12, further including a grip pad on a bottom side of the base.

Example 14 includes the lighter of any of Examples 1-13, further including a fuel level window on a side of the base to indicate a level of fuel in the lighter.

Example 15 includes the lighter of any of Examples 1-12, further including a lock on a side of the base, the lock to prevent movement of the button.

Example 16 includes the lighter of any of Examples 1-15, further including a flame adjustment dial on a side of the base. The flame adjustment dial is to increase or decrease fuel flow through the nozzle to change a size of the flame.

Example 17 includes the lighter of any of Examples 1-16, wherein the lighter is a click button lighter.

Example 18 is a lighter comprising a base, a flame ignition assembly at least partially disposed in the base, the flame ignition assembly including a nozzle, a button to, when depressed, cause the flame ignition assembly to produce a flame at the nozzle, and a lid removably positionable on the base over the button. The lid has a cavity extending into a bottom side of the lid, the cavity usable as an ashtray when the lid is detached from the base.

Example 19 includes the lighter of Example 18, wherein the bottom side of the lid has a notch to support a smokeable object.

Example 20 includes the lighter of Examples 18 or 19, wherein the lid has a same cross-sectional shape as the base.

From the foregoing, it will be appreciated that example lighters have been disclosed that can be easily activated from any orientation. As such, the example lighters do not need to be positioned in a specific orientation in a hand of user. Further, multiple people positioned around the lighter (e.g., when the lighter is positioned on a table or other surface) can activate the lighter from their respective positions without moving the lighter.

Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

The following claims are hereby incorporated into this Detailed Description by this reference, with each claim standing on its own as a separate embodiment of the present disclosure.

What is claimed is:

1. A lighter comprising:

a base;

a flame ignition assembly at least partially disposed in the base, the flame ignition assembly including a nozzle; and a button having an opening, the nozzle disposed in the opening of the button such that the button surrounds an entire periphery of the nozzle, the button to, when depressed, cause the flame ignition assembly to produce a flame at the nozzle.

2. The lighter of claim 1, wherein the opening extends through a center of the button.

3. The lighter of claim 1, wherein a central axis of the opening is coaxial with a longitudinal axis of the base.

4. The lighter of claim 1, wherein the button includes a platform positioned parallel to and spaced from the base, the platform to be pressed by a person to move the button toward the base.

5. The lighter of claim 4, wherein the base includes a nozzle guide extending from the base, the nozzle guide disposed in the opening of the button, the nozzle disposed in the nozzle guide.

6. A lighter comprising:

a base including a nozzle guide extending from the base;

a flame ignition assembly at least partially disposed in the base, the flame ignition assembly including a nozzle, the nozzle disposed in the nozzle guide; and a button having an opening, the nozzle guide with the nozzle disposed in the opening of the button, the button to, when depressed, cause the flame ignition assembly to produce a flame at the nozzle, the button including a platform positioned parallel to and spaced from the base, the platform to be pressed by a person to move the button toward the base, wherein the button has an extended position and a depressed position, the nozzle guide disposed below a top side of the platform when the button is in the extended position, and the nozzle guide extends from the top side of the platform when the button is in the depressed position.

7. The lighter of claim 5, wherein the flame ignition assembly includes four nozzles arranged in a 2×2 configuration.

8. The lighter of claim 4, wherein the platform has a same cross-sectional shape as the base.

9. The lighter of claim 4, wherein the base has an opening in a top side of the base, and wherein the button has a guide extending from a bottom side of the platform and into the opening in the top side of the base.

10. The lighter of claim 4, wherein a top side of the platform is ribbed.

11. The lighter of claim 1, further including a lid removably positionable on the base over the button, the lid having a cavity formed in a bottom side of the lid such that the lid can serve as an ashtray when the lid is detached from the base.

12. The lighter of claim 11, wherein the bottom side of the lid has a notch to support a smokeable product.

13. The lighter of claim 1, further including a grip pad on a bottom side of the base.

14. The lighter of claim 1, further including a fuel level window on a side of the base to indicate a level of fuel in the lighter.

15. The lighter of claim 1, further including a lock on a side of the base, the lock to prevent movement of the button.

16. The lighter of claim 1, further including a flame adjustment dial on a side of the base, the flame adjustment dial to increase or decrease fuel flow through the nozzle to change a size of the flame.

17. The lighter of claim 1, wherein the lighter is a click button lighter.

18. A lighter comprising:

a base;

a flame ignition assembly at least partially disposed in the base, the flame ignition assembly including a nozzle;

a button to, when depressed, cause the flame ignition assembly to produce a flame at the nozzle; and a lid removably positionable on the base over the button and forming a bottom edge surrounding a cavity, the bottom edge engaged with the base when the lid is disposed on the base, the lid having the cavity extending into a bottom side of the lid, the cavity usable as an ashtray when the lid is detached from the base and turned upside down, the bottom edge having a notch to support a smokeable object when the lid is detached from the base and used as an ashtray.

19. The lighter of claim 18, wherein the lid has a same cross-sectional shape as the base.

* * * * *